US006617802B2

(12) United States Patent
Roh

(10) Patent No.: US 6,617,802 B2
(45) Date of Patent: Sep. 9, 2003

(54) APPARATUS FOR RECOVERING ENERGY USING MAGNETIC COUPLED INDUCTOR IN PLASMA DISPLAY PANEL DRIVING SYSTEM AND METHOD FOR DESIGNING THE SAME

(75) Inventor: Chung-wook Roh, Yongin-si (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/141,786

(22) Filed: May 10, 2002

(65) Prior Publication Data

US 2003/0057854 A1 Mar. 27, 2003

(30) Foreign Application Priority Data

Aug. 28, 2001 (KR) ..... 2001-52110

(51) Int. Cl.[7] ..... G09G 3/28

(52) U.S. Cl. ..... 315/169.4; 315/169.3; 345/60; 345/70

(58) Field of Search ..... 315/169.3, 169.2, 315/169.1, 169.4; 345/60, 55, 37, 58, 61, 56, 70

(56) References Cited

U.S. PATENT DOCUMENTS 4,866,349 A * 9/1989 Weber et al. ..... 315/169.4
5,642,018 A * 6/1997 Marcotte ..... 315/169.4
5,670,974 A * 9/1997 Ohba et al. ..... 345/60
6,150,999 A * 11/2000 Chen et al. ..... 345/60
6,175,192 B1 * 1/2001 Moon ..... 315/169.3
6,538,627 B1 * 3/2003 Whang et al. ..... 345/60

* cited by examiner

*Primary Examiner*—Don Wong
*Assistant Examiner*—Ephrem Alemu
(74) *Attorney, Agent, or Firm*—Sughrue Mion, PLLC

(57) ABSTRACT

An apparatus for recovering energy using a magnetic coupled inductor so as to drive a plasma display panel (PDP) and a method for designing the same. Accordingly, reactive power and heat dissipation amount are reduced without having an additional isolation gate driver. The apparatus improves the recovery rate of the reactive power by applying the magnetic coupled inductor to an energy recovering circuit at the time of charging/discharging the PDP and by connecting the source electrode of a switching device in the energy recovering circuit to the ground. In addition, the apparatus reduces electromagnetic interference (EMI) by reducing switching loss to zero and by not generating a sudden change in panel voltage. The apparatus further simplifies the circuit structure of a gate drive terminal and reduces the number of circuit elements compared to an existing PDP drive circuit.

16 Claims, 5 Drawing Sheets

OFF
ON
ON
OFF
ON
OFF
ON
OFF

APPARATUS FOR RECOVERING ENERGY USING MAGNETIC COUPLED INDUCTOR IN PLASMA DISPLAY PANEL DRIVING SYSTEM AND METHOD FOR DESIGNING THE SAME

BACKGROUND OF THE INVENTION

1. Field of the Invention

The present invention relates to an apparatus and method for driving a plasma display panel (PDP), and more particularly, to an apparatus for recovering energy using a magnetic coupled inductor for driving a PDP and a method for designing the same so that reactive power and heat dissipation amount are reduced without having an additional isolation gate driver. The present application is based on Korean Application No. 2001-52110, filed Aug. 28, 2001, which is incorporated herein by reference.

2. Description of the Related Art

A conventional PDP is a next generation flat display device for displaying characters and images by using plasma which is generated by gas discharge. Depending on the size of the PDP, several hundred thousand to several million pixels are arranged in the PDP in the form of a matrix.

FIG. 1 shows the structure of a conventional alternating current-PDP (AC-PDP) sustain discharge circuit, which is suggested by U.S. Pat. No. 4,866,349 to Weber et al. In the case of the AC-PDP, a display panel is assumed as a load having a panel capacitance Cp. The basic operation of a PDP driving circuit is described in Weber et al.

FIGS. 2*a* through 2*j* show an output voltage Vp according to a switching sequence and the waveforms of current IL, which flows through an inductor Lc. The AC-PDP sustain discharge circuit is represented as the following four modes according to the switching sequence.

(1) Mode 1

Before a metal oxide semiconductor field effect transistor (MOSFET) switch Sa1 becomes conductive, a MOSFET switch Sx2 is conductive and an output voltage Vp between both terminals of a panel is maintained as 0V. When the MOSFET switch Sa1 becomes conductive at time t0, mode 1 operation starts. An LC resonance circuit is formed through a path of Cc1-Sa1-Da1-Lc1-Cp (panel) so that a resonance current flows through an inductor Lc1 and the output voltage Vp increases. The current of the inductor Lc1 becomes 0 and the output voltage Vp becomes a voltage +Vpk at time t1.

(2) Mode 2

The MOSFET switch Sa1 is opened and a MOSFET switch Sy1 is closed at time t1. Here, the voltage between the drain and source of the MOSFET switch Sy1 has a sudden change as a voltage Vpk at time t1 so that a switching loss is caused. In mode 2, the output voltage Vp is maintained as a voltage +Vs and the panel maintains discharge.

(3) Mode 3

A MOSFET switch Sa2 is closed and the MOSFET switch Sy1 is opened at time t2. The LC resonance circuit is formed through a path of Cp (panel)-Lc1-Da2-Sa2-Cc1 in mode 3 so that the resonance current flows through the inductor Lc1 and the output voltage Vp is reduced. The current of the inductor Lc1 becomes 0, and the output voltage Vp becomes a voltage +Vpk at time t3.

(4) Mode 4

The MOSFET switch Sa2 is closed and a MOSFET switch Sy2 is opened at time t3. Here, the voltage between drain and source of the MOSFET switch Sy2 becomes −Vpk at time t3 so as to generate a switching loss. The output voltage Vp is maintained as 0V in mode 4. If the MOSFET switch Sx2 is closed and the MOSFET switch Sb1 is opened at time t0', another half period is repeated.

The conventional energy recovering circuit requires four switches so that the number of gate drivers is increased, and further requires an isolation gate driver since the switches in the energy recovering unit are not grounded. As a result, an ideal switching operation is difficult to achieve when high frequency switching is performed. In case that switching-on time is very short (300 ns), the switching-on operation cannot be performed during the delay time of the isolation gate driver, resulting in improper operation. Additionally, in case that a panel resistive device and a device resistance exist, a sudden change occurs in the panel voltage as shown in FIG. 2*i*. As a result, an electromagnetic interference (EMI) and a reactive power increase.

SUMMARY OF THE INVENTION

To solve the above-described problems, it is an objective of the present invention to provide an apparatus for recovering energy using a magnetic coupled inductor and a method for designing the same so as to reduce the number of energy recovering circuit elements by using a magnetic coupled inductor circuit and to reduce reactive power and electromagnetic interference (EMI).

To accomplish the above-described object, according to the present invention there is provided an apparatus for recovering energy using a magnetic coupled inductor in a plasma display panel (PDP) driving system, the apparatus comprising: first and second switching means for switching on and off an electric connection between an input terminal and the ground in correspondence to a predetermined energy recovering sequence switching control signal; and a magnetic coupled inductor in which first and second coils are magnetically coupled by respectively connecting first terminals of the first and second coils to both terminals of a PDP and by respectively connecting second terminals of the first and second coils to input terminals of the first and second switching means.

A method for designing an energy recovering circuit using a magnetic coupled inductor in a PDP driving system according to the present invention to accomplish another objective comprises the steps of: performing a switching process in which the magnetic coupled inductor whose first and second coils are magnetically coupled is connected to both terminals of a PDP; and currents of the first and second coils are connected to or disconnected from the ground in correspondence to a predetermined energy recovering sequence, so that the voltage of the PDP is linearly charged/discharged at a charge/discharge mode in a sustain section.

DETAILED DESCRIPTION OF THE INVENTION

Figure 1:
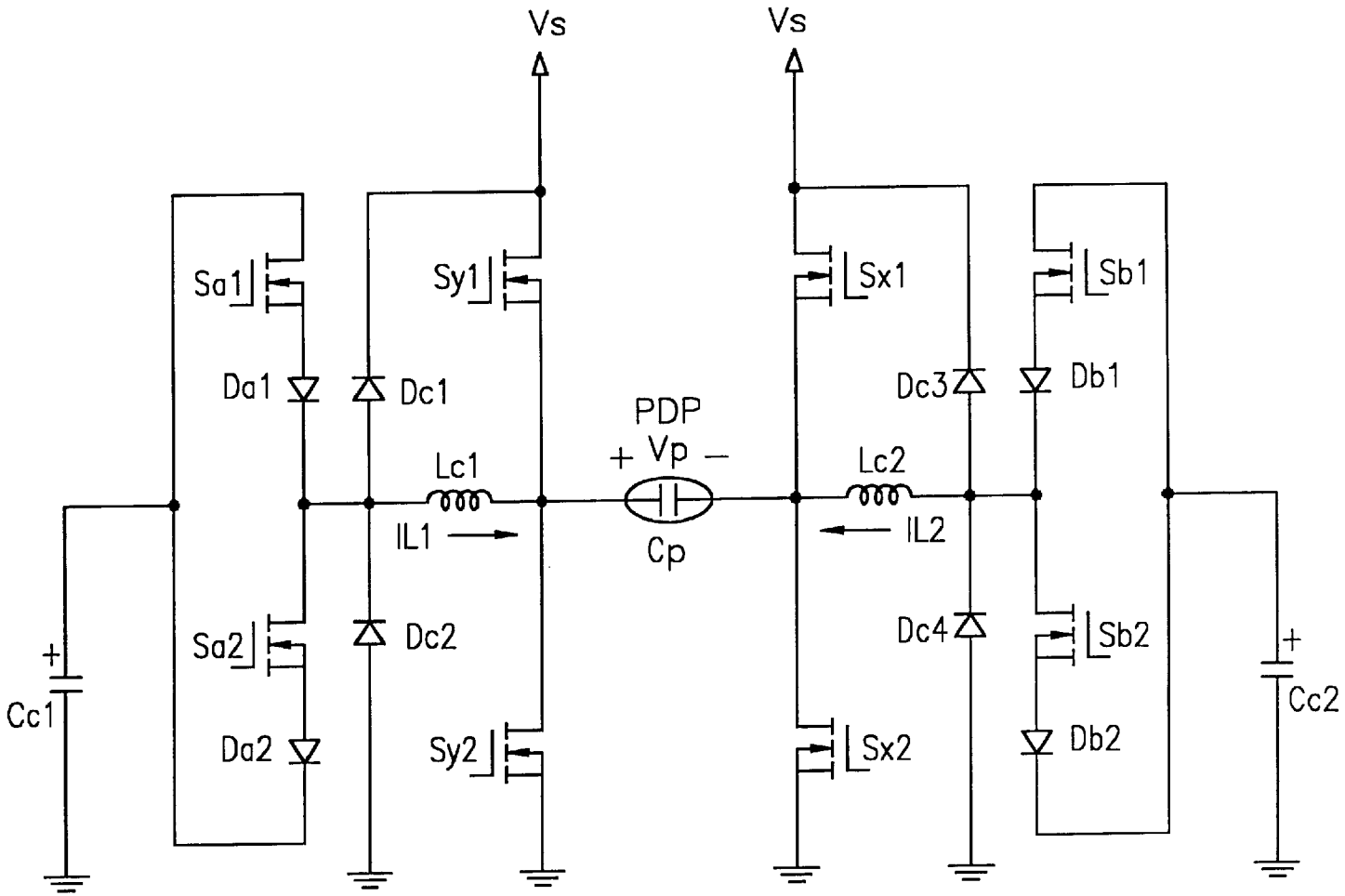
FIG. 1 (PRIOR ART)
FIG. 1 illustrates the structure of a conventional plasma display panel (PDP) driving device.
Figure 2:
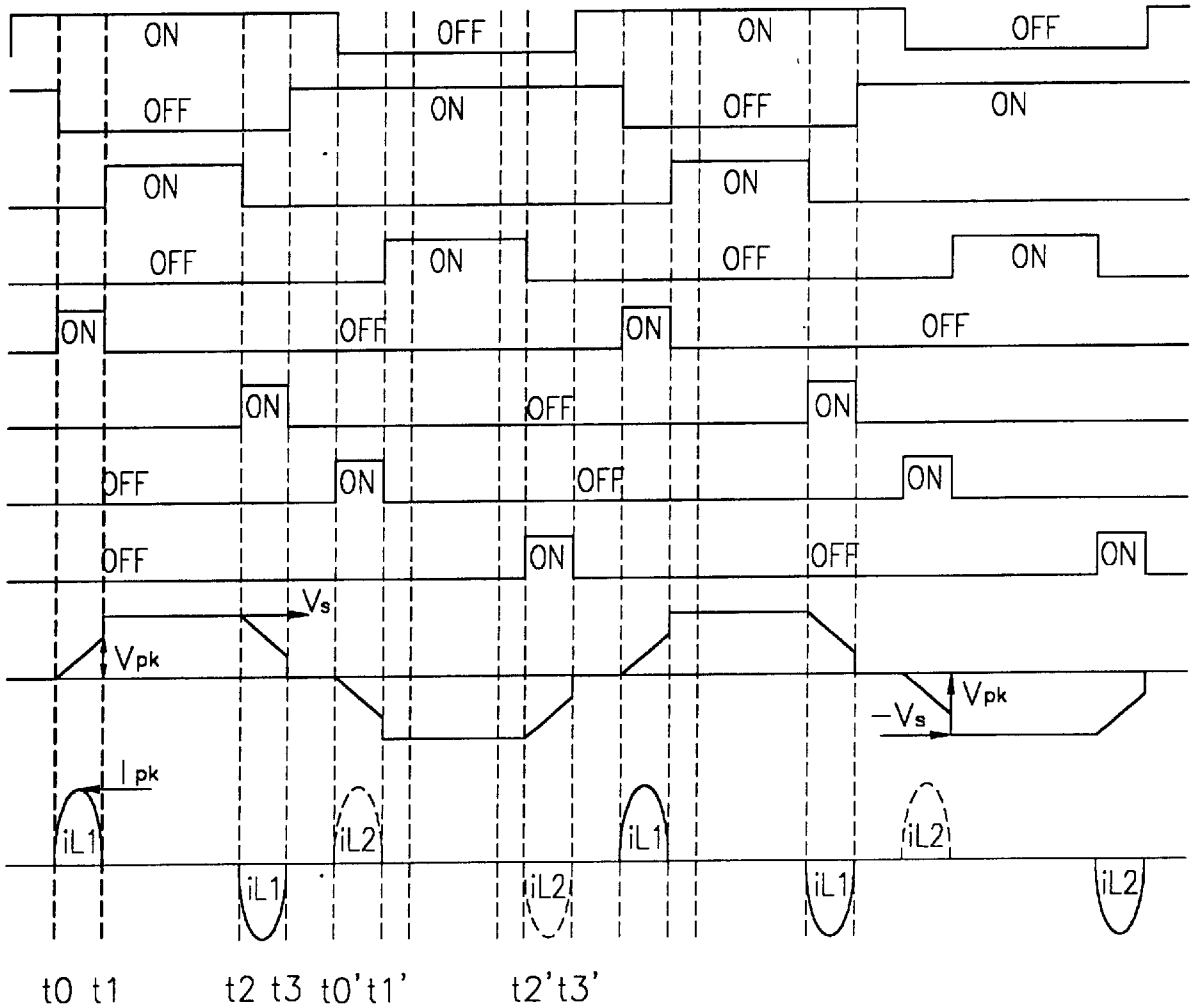
FIGS. 2*a* through 2*j* illustrate waveforms of major signals which are applied to the PDP driving device shown in FIG. 1.
Figure 3:
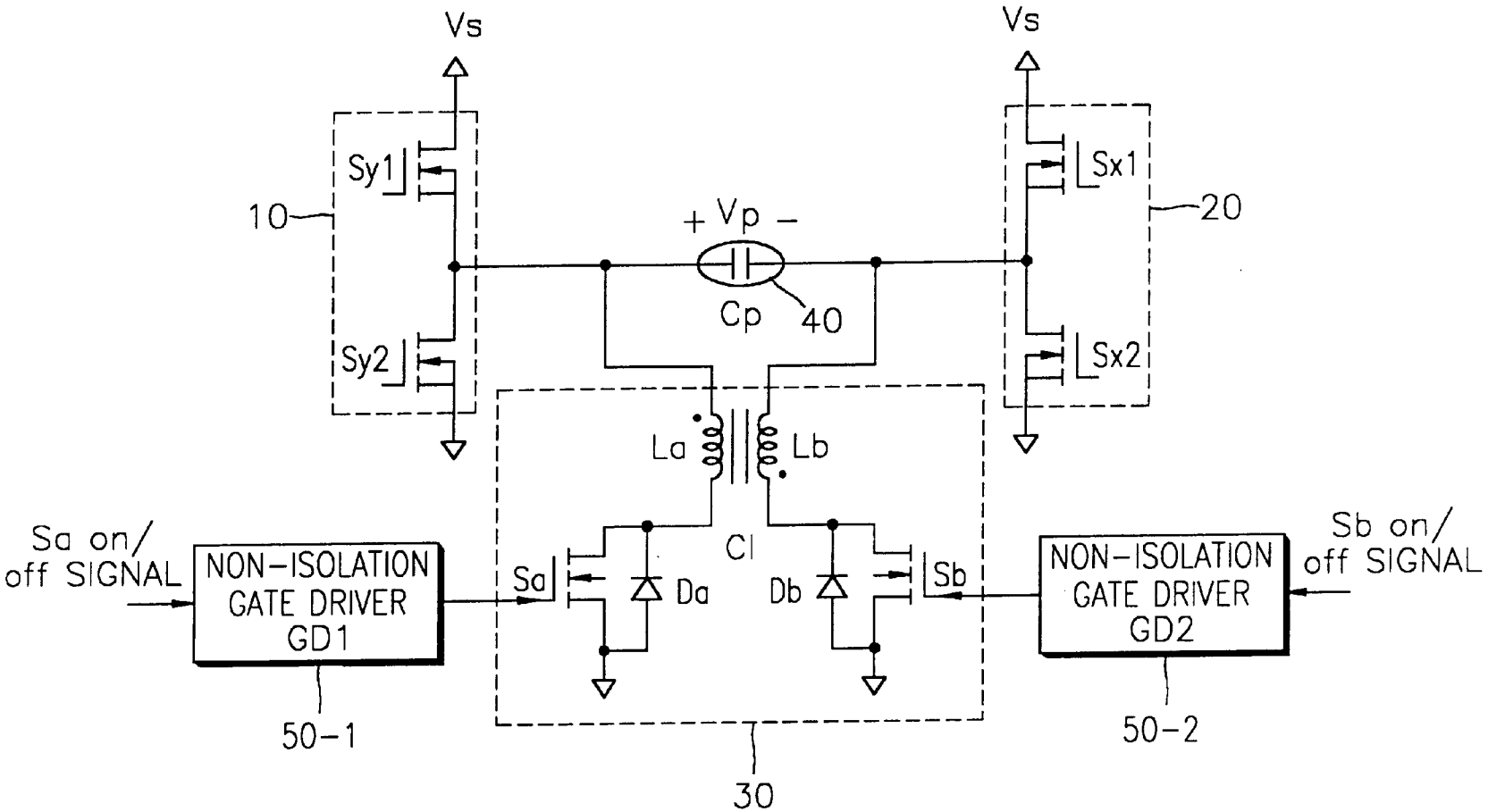
FIG. 3 illustrates the structure of an energy recovering apparatus using a magnetic coupled inductor according to the present invention.
Figures 4A, 4B, 4C, 4D, 4E, 4F, 4G, 4H, 4I:
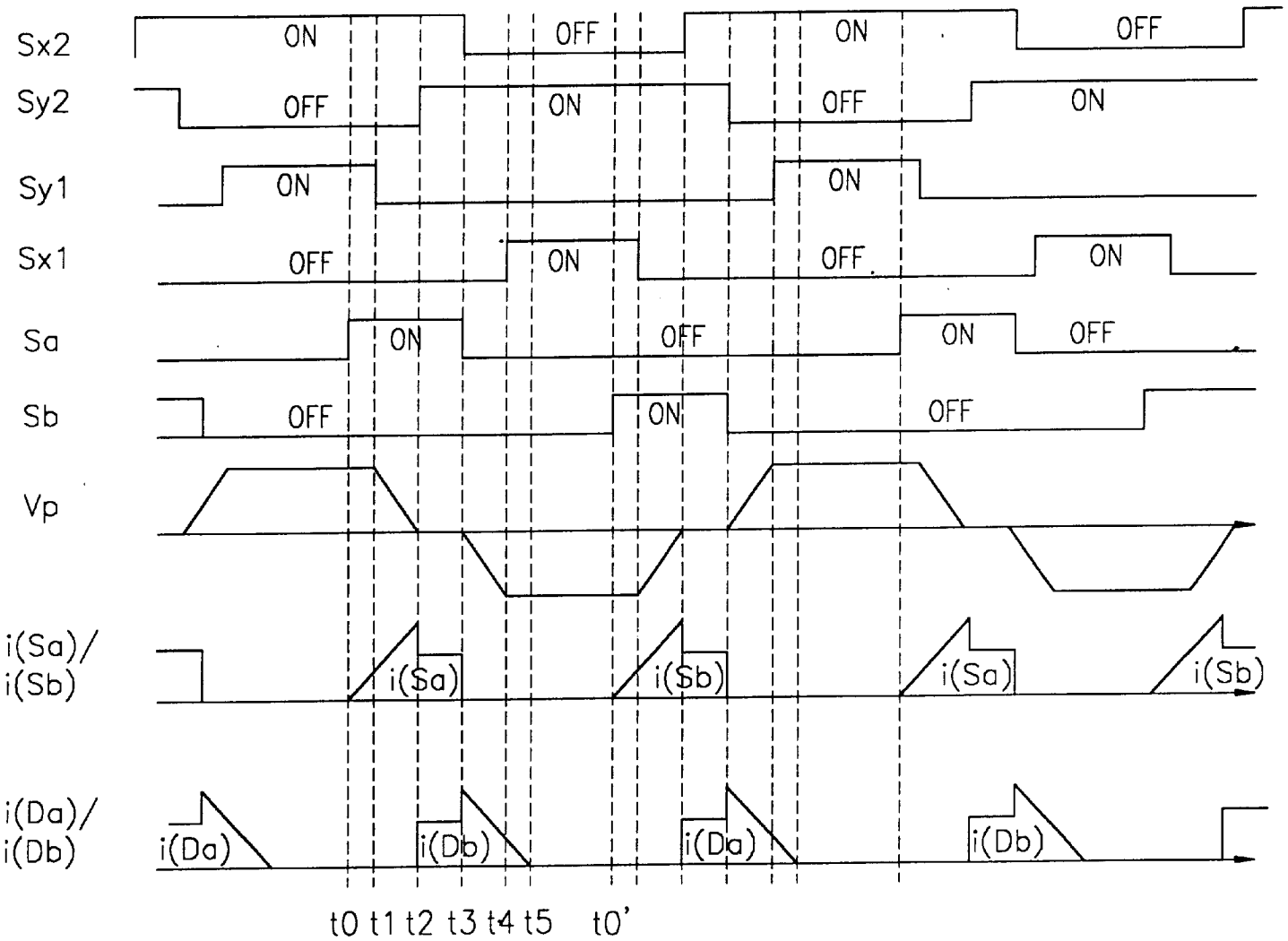
FIGS. 4*a* through 4*i* illustrate waveforms of main signals which are applied to the energy recovering apparatus shown in FIG. 3.

Referring to FIG. 3, an apparatus for recovering energy using a magnetic coupled inductor according to the present invention includes a scan electrode sustain switching circuit 10, a common electrode sustain switching circuit 20, an energy recovering unit 30, a plasma display panel (PDP) Cp 40, and first and second non-isolation gate drivers (GD1 and GD2) 50-1 and 50-2.

The scan electrode sustain switching circuit 10 and the common electrode sustain switching circuit 20 include a plurality of switches Sy1, Sy2, Sx1, and Sx2 for applying an alternating current rectangular wave voltage of high frequency to the PDP 40 in a PDP light-emitting section.

The scan electrode sustain switching circuit 10 and the common electrode sustain switching circuit 20 alternatively repeat conduction/non-conduction operation by pairs of switches (Sy1 and Sy2) and (Sx1 and Sx2) during a light-emitting process.

The energy recovering unit 30 is a circuit, which is used for suppressing power consumption by preventing a sudden change in panel voltage and a capacitive displacement current in a sustain mode. In particular, the energy recovering unit 30 includes a magnetic coupled inductor CI, two switches Sa and Sb, and two diodes Da and Db. The diodes Da and Db use embedded body diodes of the metal oxide semiconductor field effect transistor (MOSFET) switches Sa and Sb in order to reduce the number of components. The diodes Da and Db are additionally designed between drain-source electrodes of the MOSFET switches Sa and Sb to improve performance. It is effective that the ratio of the number of primary and secondary windings in the magnetic coupled inductor CI is 1:1. Here, a primary inductance is represented as La, and a secondary inductance is represented as Lb.

Therefore, the switches Sa and Sb of the energy recovering unit 30 with respect to the circuit structure of the present invention have the source electrodes, which are grounded so that an isolation gate driver such as a boot strap circuit is not required. Accordingly, the entire circuit is simplified, and a low loss gate driver of high frequency is conveniently designed.

FIGS. 4*a* through 4*i* illustrate voltage/current waveforms of an energy recovering circuit according to the present invention. Basically, an on/off drive signal of a sustain switch is equal to that of a conventional circuit. The operational principles of the apparatus for recovering energy in case of applying each switch signal will be described mode by mode.

(1) Mode 1 (t0–t1)

The switches Sy1 and Sx2 are opened before time t0 so that the panel voltage Vp is maintained at value Vs for sustaining discharge. At time t0, if the switch Sa of the energy recovering unit 30 is closed, current $i_{La}$ of the coupled inductor La linearly increases with a slope of Vs/La. At time t1, a current $i_{La}$(t1) becomes Vs(t1–t0)/La. During that time, a reverse bias is applied to the diode Db so that the current of the coupled inductor Lb becomes zero. When switch Sy1 is opened at time t1, mode 1 ends.

(2) Mode 2 (t1–t2)

When the switch Sy1 is closed at time t1, the panel is gradually discharged through a resonance path Sx2-Cp-La-Sa so that the panel voltage Vp is reduced. In mode 2, the current $i_{La}$ and the panel voltage Vp are represented by the following equations 1 and 2.

$$i_{La}(t) = \frac{V_s(t_1 - t_0)}{L_a}\cos\omega_n(t - t_1) + \frac{V_s}{Z_n}\sin\omega_n(t - t_1) \tag{1}$$

$$v_p(t) = V_s\cos\omega_n(t - t_1) - \frac{V_s(t_1 - t_0)}{L_a}Z_n\sin\omega_n(t - t_1) \tag{2}$$

$$\text{where, } \omega_n = \frac{1}{\sqrt{L_a C_p}},\ Z_n = \sqrt{\frac{L_a}{C_p}}.$$

A remarkable point, which is different from a conventional circuit, is that the panel voltage Vp can be precisely reduced to 0V even if a parasitic resistance exists due to the existence of the current $i_{La}$(t1). When the panel voltage Vp becomes zero, mode 2 ends.

(3) Mode 3 (t2–t3)

When the panel voltage Vp becomes zero at time t2, the voltage of the coupled inductor becomes zero. In that case, halves of a current $i_{La}$(t2), which flows toward the primary side continue to flow through paths Dy2 (body diode of Sy2)-La-Sa and Db-Lb-Sx2, respectively. If the switch Sy2 is turned on in mode 3, the switch Sy2 is turned on by a zero voltage switching without a switching loss due to the conducting state of the diode Dy2. The panel voltage Vp remains zero in a path of Sx2-Cp-Sy2 in mode 3. When the switch Sx2 is opened at time t3, mode 3 ends.

(4) Mode 4 (t3–t4)

If the switch Sx2 is opened at time t3, the voltage polarity of an inductor is inverted by a characteristic of the inductor, which maintains a flowing current so that an end point of the inductor becomes negative. Here, the current $i_{La}$ of the primary side La is transmitted to the secondary side. With an initial value of the current $i_{La}$(t2), the panel is charged through the resonance path Db-Lb-Cp-Sy2. The current $i_{Lb}$ of the secondary side Lb and the panel voltage Vp are represented by the following equations 3 and 4 in mode 4.

$$i_{Lb}(t) = i_{La}(t_2)\cos\omega_n(t - t_3) \tag{3}$$

$$v_p(t) = -i_a(t_2)Z_n\sin\omega_n(t - t_3) \tag{4}$$

Here, if the value of the current $i_{La}(t^2)$ is designed correctly, the panel voltage Vp is gradually charged to a voltage −Vs so that the panel voltage Vp precisely increases to the voltage −Vs. Under the same condition, the panel voltage Vp becomes the voltage −Vs at time t4 and mode 4 ends.

(5) Mode 5 (t4–t5)

If the panel voltage Vp becomes the voltage −Vs at time t4, the current $i_{Lb}$ of the secondary side Lb is linearly reduced with a slope of −Vs/Lb through the path of Db-Lb-Dx1 (the body diode of Sx1). If the switch Sx1 is turned on, the switch Sx1 is turned on by a zero voltage switching without a switching loss due to the conducting state of the diode Dx1. The panel voltage Vp becomes the voltage −Vs in mode 5 so that the panel voltage Vp maintains sustain mode. When the current $i_{Lb}$ becomes zero at time t5, mode 5 ends.

(6) Mode 6 (t5–t0')

The current $i_{Lb}$ becomes zero and the circuit sustains only a gas-discharging current at time t5 so that the panel maintains a light-emission condition. Usually, duration lengths of mode 5 and mode 6 are given as a design standard according to characteristics of the panel and discharge. If the energy recovering switch Sb is turned on at time t0', the operation for the other half period is repeated.

Figure 5:
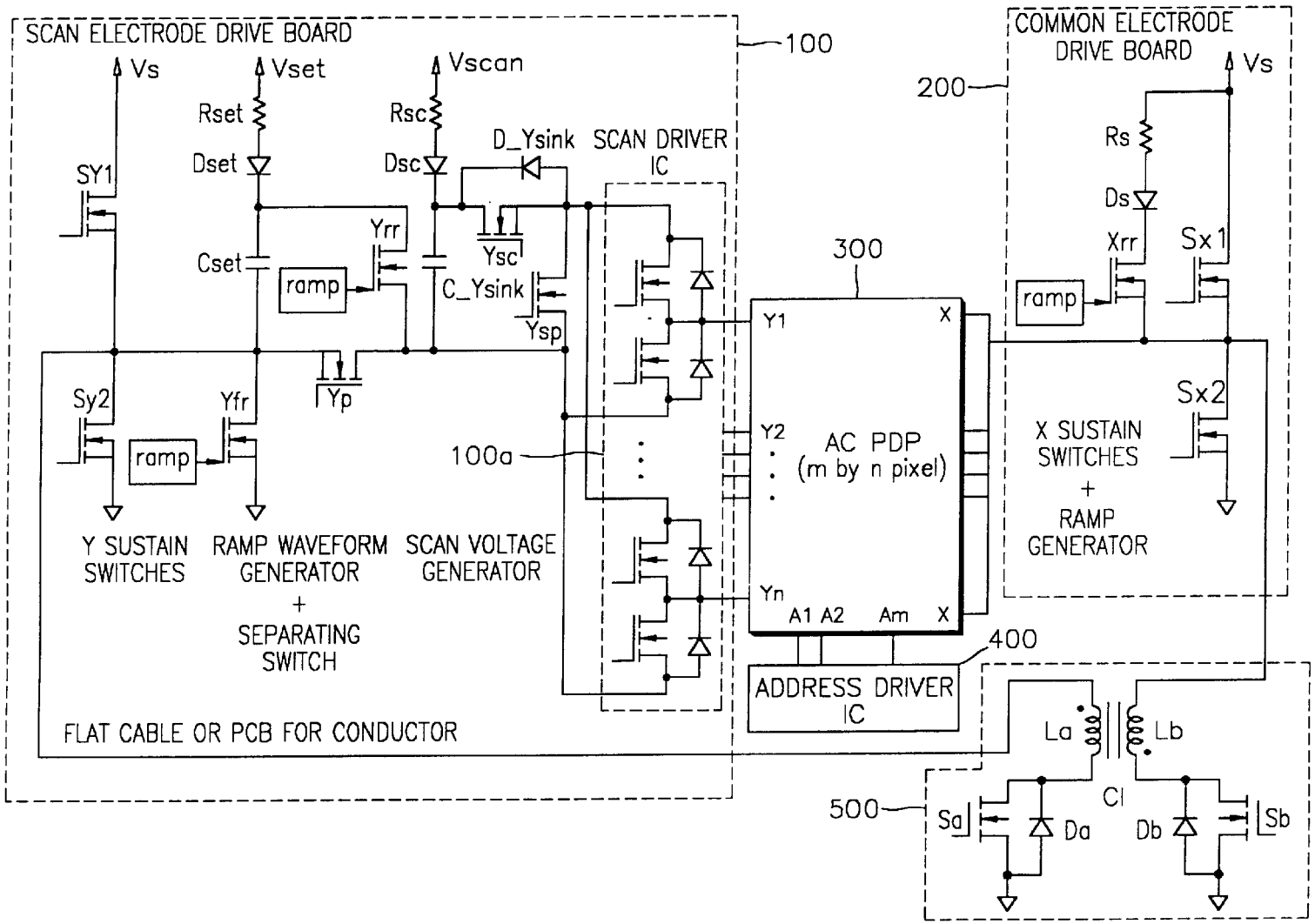
FIG. 5 illustrates the structure of a PDP driving system to which the energy recovering apparatus using the magnetic coupled inductor according to the present invention is applied.

FIG. 5 illustrates the structure of a PDP driving device to which the energy recovering apparatus using the magnetic coupled inductor according to the present invention is applied. The PDP panel driving device includes a scan electrode drive board 100, a common electrode drive board 200, a PDP 300, an address scan drive IC 400, and an energy recovering unit 500.

X-electrode sustain switches Sx1 and Sx2, and an X-electrode ramp waveform generation circuit (Xrr, Ds, Rs, and a ramp signal generate circuit) are embedded in the common electrode drive board 200. Y-electrode sustain switches Sy1 and Sy2, a Y-electrode ramp waveform generation circuit (Yfr, Yrr, Cset, Dset, Rset, and a ramp signal generate circuit), a separation circuit Yp, and a scan pulse generation circuit (100*a*, Ysc, Ysp, D_Ysink, Rsc, Dsc, and C_Ysink) are embedded in the scan electrode drive board 100.

The common electrode drive board 200 and the scan electrode drive board 100 are connected to an X-electrode terminal and a Y-electrode terminal of the PDP 300, respectively. The address scan drive IC 400 is connected to an address terminal of the PDP 300.

The primary and secondary coils of the magnetic coupled inductor, which forms the energy recovering unit 500 in the present invention are electrically connected to the scan electrode drive board 100 and the common electrode drive board 200 by a cable or a PCB pattern, respectively.

The scan electrode and common electrode sustain switches perform an operation of applying an alternating current rectangular wave voltage of high frequency to the panel (alternating current-PDP) 300 during a PDP light-emission period.

The separation circuit Yp is used as a switch for separating the circuit operation of a sustain section of the PDP 300 from those of other sections (an address section and a reset section) of the PDP 300 in an address display separation (ADS) system.

The X and Y electrode ramp waveform generation circuit is formed to generate a ramp type high voltage to the panel for the reset section.

For the scan pulse generation circuit, the scan driver IC 100*a*, which includes a shift resistor+voltage buffer, applies a horizontal synchronizing signal of a PDP screen for the address section. The scan driver IC 100*a* is short for the other sections.

In an embodiment, various switches included in the above circuit are metal oxide field-effect transistors (MOSFET).

A PDP driving operation and a switching sequence for recovering energy in a sustain section are the same as in the circuit structures and waveforms, which are shown in FIGS. 3 and 4*a* through 4*i*. Accordingly, the detailed descriptions of the PDP driving operation and the switching sequence are omitted.

As described above, the present invention provides an effect of improving a recovering rate of the reactive power by applying the magnetic coupled inductor to the energy recovering circuit at the time of charging/discharging the PDP and by connecting the source terminals of the switching devices in the energy recovering circuit to the ground. In addition, the present invention provides an effect of reducing electromagnetic interference (EMI) by reducing the switching loss into zero and not generating a sudden change in the panel voltage. The present invention further provides effects of simplifying the circuit structure of a gate drive terminal and reducing the number of circuit elements compared to a conventional PDP drive circuit.

The present invention is implemented as a method, an apparatus, and a system. In the case of implementing the present invention as software, elements of the present invention are code segments, which perform necessary operations. A program or the code segments are preferably stored in a processor readable medium or preferably transmitted by a computer data signal, which is coupled with a carrier in a transfer medium or a communication network. It is preferable that the processor readable medium includes any medium, which stores or transmits information. Examples of the processor readable media are an electronic circuit, a semiconductor memory device, a ROM, a flash memory, an electrical erasable programmable ROM (EEPROM), a floppy disk, an optical disk, a hard disk, an optical fiber medium, a radio frequency (RF) network, and the like. The computer data signal includes any signal, which is transmitted through transfer media such as an electronic network channel, an optical fiber, air, an electronic system, an RF network, and the like.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An apparatus for recovering energy using a magnetic coupled inductor in a plasma display panel (PDP) driving system, the energy recovering apparatus comprising:

first and second switches for switching on and off an electrical connection between an input terminal and ground in correspondence to a predetermined energy recovering sequence switching control signal; and a magnetic coupled inductor in which first and second coils are magnetically coupled by respectively connecting first terminals of the first and second coils to both terminals of a PDP and by respectively connecting second terminals of the first and second coils to input terminals of the first and second switches.

2. The apparatus of claim 1, wherein a ratio of the winding numbers of primary and secondary coils in the magnetic coupled inductor is designed to be 1:1.

3. The apparatus of claim 1, wherein the first and second switches are metal oxide semiconductor field effect transistor (MOSFET) switches.

4. The apparatus of claim 3, wherein a respective diode is placed between the drain and source electrodes of each of the MOSFET switches.

5. The apparatus of claim 4, wherein the diode is a body diode, which is embedded in the respective MOSFET switch.

6. The apparatus of claim 3, wherein the source and drain electrodes of each of the MOSFET switches are respectively connected to the ground and the magnetic coupled inductor, and the output terminal of a non-isolation gate driver is coupled with the gate electrode of each of the MOSFET switches.

7. The apparatus of claim 1, wherein the current of the magnetic coupled inductor varies linearly during a charge/discharge mode in a sustain section.

8. A plasma display panel (PDP) driving device having a switching sequence, which repeats a reset section, an address section, and a sustain section, the PDP driving device comprising:

a Y-electrode sustain switching circuit for applying a rectangular wave voltage of high frequency to a Y-electrode of a PDP for the sustain section;

a separation circuit for separating circuit operations of the sustain section, the address section, and the reset section;

a Y-electrode ramp waveform generation circuit for applying a ramp type high voltage to the Y-electrode of the PDP for the reset section;

a scan pulse generation circuit, which applies a horizontal synchronizing signal to the address section;

an X-electrode sustain switching circuit for applying the rectangular wave voltage of high frequency to an X-electrode of the PDP for the sustain section;

an X-electrode ramp waveform generation circuit for applying the ramp type high voltage to the X-electrode of the PDP for the reset section; and an energy recovering circuit, which is formed of a magnetic coupled inductor connected at both terminals of the PDP at the time of charging/discharging the PDP in the sustain section, wherein the switching sequence is controlled so as to linearly charge/discharge the voltage of the PDP.

9. The PDP driving device of claim 8, wherein the energy recovering circuit comprises:

first and second switches for switching on and off an electrical connection between an input terminal and ground in correspondence to a predetermined energy recovering sequence switching control signal; and the magnetic coupled inductor in which first and second coils are magnetically coupled by respectively connecting first terminals of the first and second coils to X- and Y-electrodes of the PDP and by respectively connecting second terminals of the first and second coils to input terminals of the first and second switches.

10. The PDP driving device of claim 8, wherein a ratio of the winding numbers of primary and secondary coils in the magnetic coupled inductor is designed to be 1:1.

11. The PDP driving device of claim 8, wherein the first and second switches are MOSFET switches, respectively.

12. The PDP driving device of claim 11, wherein a respective diode is disposed between the drain and source electrodes of each of the MOSFET switches.

13. The PDP driving device of claim 12, wherein the diode is a body diode, which is embedded in its respective MOSFET switch.

14. The PDP driving device of claim 11, wherein the source and drain electrodes of each of the MOSFET switches are respectively connected to the ground and the magnetic coupled inductor, and the output terminal of a non-isolation gate driver is coupled with the gate electrode of each of the MOSFET switches.

15. The PDP driving device of claim 8, wherein the current of the magnetic coupled inductor linearly varies at a charge/discharge mode in the sustain section.

16. A method for designing an energy recovering circuit using a magnetic coupled inductor in a plasma display panel (PDP) driving system, the method for designing the energy recovering circuit comprises the steps of:

performing a switching process in which the magnetic coupled inductor whose first and second coils are magnetically coupled is connected to both terminals of a PDP; and conducting or blocking the currents of the first and second coils to or from the ground in correspondence to a predetermined energy recovering sequence so that the voltage of the PDP is linearly charged/discharged at a charge/discharge mode in a sustain section.

* * * * *